US007212643B2

(12) United States Patent
Bock

(10) Patent No.: US 7,212,643 B2
(45) Date of Patent: May 1, 2007

(54) REAL-EAR ZOOM HEARING DEVICE

(75) Inventor: Friedrich Bock, Waiblingen-Hegnach (DE)

(73) Assignee: Phonak AG, Stafa (CH)

( * ) Notice: Subject to any disclaimer, the term of this patent is extended or adjusted under 35 U.S.C. 154(b) by 346 days.

(21) Appl. No.: 10/775,956

(22) Filed: Feb. 10, 2004

(65) Prior Publication Data

US 2005/0175204 A1 Aug. 11, 2005

(51) Int. Cl.
*H04R 25/00* (2006.01)

(52) U.S. Cl. ..... 381/330; 381/92; 381/313

(58) Field of Classification Search ..... 381/26, 381/91, 92, 111, 122, 312, 313, 330, 355–360, 381/322

See application file for complete search history.

(56) References Cited

U.S. PATENT DOCUMENTS

| | | | | |
|---|---|---|---|---|
| 4,198,705 | A | 4/1980 | Massa | |
| 5,473,701 | A | 12/1995 | Cezanne et al. | |
| 5,581,620 | A | 12/1996 | Brandstein et al. | |
| 5,825,898 | A | 10/1998 | Marash | |
| 6,178,248 | B1 | 1/2001 | Marash | |
| 6,603,861 | B1 * | 8/2003 | Maisano et al. | 381/92 |
| 2001/0031053 | A1 | 10/2001 | Feng et al. | |
| 2003/0142836 | A1 | 7/2003 | Warren et al. | |
| 2005/0058312 | A1 | 3/2005 | Weidner | |
| 2005/0094834 | A1 | 5/2005 | Chalupper | |
| 2005/0105749 | A1 | 5/2005 | Niederdrank et al. | |

FOREIGN PATENT DOCUMENTS

| | | | |
|---|---|---|---|
| WO | 99/09786 | A | 2/1999 |
| WO | WO 99/09786 | A1 | 2/1999 |

* cited by examiner

*Primary Examiner*—Huyen Le
(74) *Attorney, Agent, or Firm*—Pearne & Gordon LLP

(57) ABSTRACT

A hearing device has a behind-the-ear microphone arrangement that is not to be placed in the ear canal of the wearer. The microphone arrangement has a first microphone with an output. An electrical/mechanical output converter has a further microphone and a beam former unit with at least two inputs and an output. One beam former input is operationally connected to the output of the first microphone. The second beam former input is operationally connected to the output of the further microphone. The beam former output is operationally connected to an input of the output converter. The beam former unit together with the first and further microphones have a transfer characteristic for acoustical signals impinging on the first and further microphones to an electric signal at the output of the beam former. The amplification of the signal is dependent on the direction with which the acoustical signals impinge on the microphones and on the frequency of the acoustical signals. The direction measured from a reference direction of 0° with respect to the direction in which the wearer is facing, such that the outward direction of the ear canal is at about 90°. The transfer characteristic has the following features: a substantially constant amplification independent of the direction of impingement at a frequency of about 1 kHz and, for a direction of impingement of about 45°, a larger amplification than for a direction of impingement of about 135° at the frequency of about 5 kHz.

10 Claims, 5 Drawing Sheets

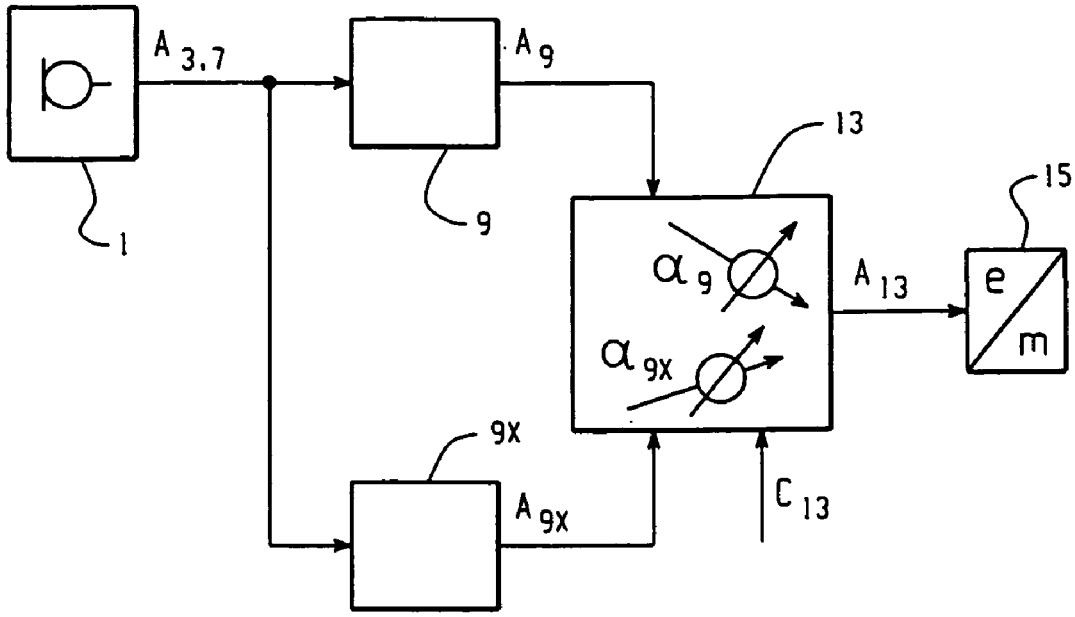
Fig. 8
Fig. 8a
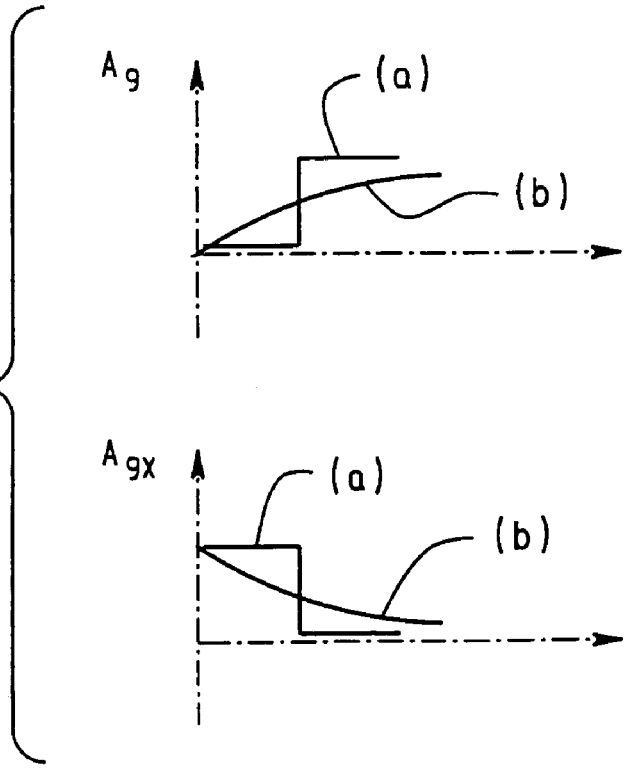

REAL-EAR ZOOM HEARING DEVICE

BACKGROUND OF THE INVENTION

The present invention departs from needs which have been recognized at behind-the-ear hearing devices, thereby especially at behind-the-ear hearing aid devices. Nevertheless, although departing from such devices, the present invention may be applied to all hearing systems where there is applied a microphone arrangement not within the ear canal, thereby especially behind the pinna of an individual's ear, the output of which operationally acting on an electrical to mechanical output converter which is applied to the same and/or the other ear of the individual. The hearing device may be a device for increasing hearing capability or a hearing protection device.

Today's behind-the-ear hearing devices and thereby especially behind-the-ear hearing aid devices may controllably be enabled to operate in the so-called omnidirectional mode. The microphone arrangement which, for this mode, may consist of one omnidirectional microphone, provides per se for an omnidirectional transfer characteristic, which means that acoustical signals impinging on the microphone arrangement are converted to an electrical output signal with a predetermined constant amplification irrespective of the direction with which such acoustical signals impinge on the arrangement. Nevertheless, once applied adjacent to the top of or behind the pinna, the acoustical to electrical transfer characteristic becomes not anymore independent of the direction at which acoustical sources appear to the microphone due to the so-called head-related transfer function HRTF, which results in some degree from "shadowing" of the acoustical signals dependent where the acoustical signal source is located with respect to the microphone arrangement.

When an individual's ear acoustical reception characteristic is investigated per se, e.g. by means of a complete-in-the-canal hearing device, CIC, as a standard the following transfer characteristics are recognized:

When, according to FIG. 1, 0° direction is defined in the direction at which individual's head H faces and 90° direction is defined perpendicularly thereto in a direction pointing outwards of individual's right ear $E_R$ one recognizes at this right ear a transfer characteristic at a frequency f of 0.5 kHz of acoustical signals as shown in FIG. 2. As may be seen the acoustical signals from acoustical sources seen under an angle of 180° to 0° are considerably attenuated, which is predominantly caused by the shadowing effect of individual's head, i.e. by the HRTF. In directions symmetrically to the 90° directivity axis, i.e. at about 45° and at about 135°, the amplification is substantially equal.

In FIG. 3 as well as in FIG. 4 the respective transfer characteristics are shown for acoustical signals at 1 kHz and at 2 kHz.

In FIG. 5 the transfer characteristic is shown at 4 kHz. When comparing the transfer characteristics at 2 kHz, with that at 4 kHz, according to the respective FIGS. 4 and 5, one recognizes an increased directivity of the transfer characteristics at 4 kHz. In fact, departing approx. at frequencies of 2 kHz of the acoustical signals, the directivity of the pinna becomes effective. Nevertheless, as frequencies above 7 kHz are of no interest whenever speech understanding is addressed, with an eye on such speech understanding, it is important to note that the pinna provides for a beam forming effect in a frequency band of 2 kHz to 7 kHz, thus with a significant frequency at 5 kHz. The beam forming effect results in a higher amplification in 45° direction than in the 135° direction. Nevertheless, also for applications of the device, where at least not speech understanding is predominantly addressed, the 5 kHz frequency is significant for pronounced pinna directivity effect.

As was mentioned above, the transfer characteristics as exemplified by FIGS. 2 to 5 are transfer characteristics at respective acoustical signal frequencies of an individual's ear per se.

When applying to such individual a microphone arrangement not in the ear canal, e.g. behind the pinna, as is customarily done by applying a behind-the-ear hearing aid device, the directivity characteristic of the pinna becomes moot, whereas the HRTF-based characteristic as of the FIGS. 2 to 4 is still effective.

Thus, an intrinsically omnidirectional beam former with microphone arranged not in the ear canal, thus especially behind the pinna will establish a transfer characteristic with substantially equal amplification symmetrical to the 90° direction. The pinna-caused beam forming characteristic with an attenuation of signals impinging from 45° relative to such signals from 135° which according to FIG. 4 is about +6 dB is lost. It results therefrom that whenever the hearing device enabled or controllably switched in omnidirectional mode will not establish for a transfer characteristics which accords to natural beam forming of the ear at frequencies above 2 kHz and, with respect to speech understanding, in the relevant frequency band up to about 7 kHz, but will establish as shown in FIG. 5 by dashed lines a transfer characteristic as if no pinna was present.

SUMMARY OF THE INVENTION

It is an object of the present invention to provide a hearing device with a microphone arrangement to be placed not in the ear canal and thus especially behind the pinna of the ear of an individual which, at least in one operating mode, provides for a transfer characteristic at least similar to that of the natural ear.

This object is achieved by a hearing device with a behind-the-ear microphone arrangement to be placed not in the ear canal of an individual's ear, wherein the microphone arrangement has at least one microphone with an output, the device further having an electrical/mechanical output converter and has a further microphone and a beam former unit. Latter has at least two inputs and an output. One input of the beam forming unit is operationally connected to the output of the one microphone and the second input of the beam former unit is operationally connected to the output of the further microphone. The output of the beamformer unit is operationally connected to an input of the output converter and establishes together with the one and the further microphones a transfer characteristic of acoustical signals impinging on the one and the further microphones to an electrical signal at the output of the beam former unit with an amplification which is dependent on the direction with which acoustical signals impinge on the microphone and on the frequency of such acoustical signals. With 0° direction being defined in direction of individual's facing and 90° direction substantially in ear canal outside direction of the ear considered, the transfer characteristic established by the beam former unit and the at least two microphones has the following features:

A substantially constant amplification independent of the direction of impinging at a frequency of the acoustical signal of 1 kHz, and for a direction of 45° a larger amplification than for a direction of 135' of said acoustical signals impinging on the microphones at a frequency of 5 kHz.

Thus, on one hand the beam former unit behaves at frequencies below 2 kHz, as at the significant frequency of 1 kHz, like an omnidirectional microphone. Applied to the head, the HRTF is effective as at the unequipped ear. At higher frequencies above 2 kHz as established by the characteristic frequency of 5 kHz, the beam former unit and microphones establish an increased amplification in forwards direction as in the 45° direction compared with attenuation in the backwards direction of 135°. This simulates the pinna directivity effect.

The ratio of amplification in 135° direction to amplification in 45° direction is selected to be approx. −6 dB. Thus, in a preferred embodiment of the hearing device according to the present invention at a frequency of 5 kHz of impinging acoustical signals the amplification in 45° direction is at least approx. 6 dB higher than the amplification in 135° direction.

As was already addressed above hearing devices of the addressed type and thereby especially behind-the-ear hearing devices are customarily equipped with different operating modes or programs which may be manually or automatically enabled, be it by remote control or by automatic evaluation of the acoustical surrounding. Thereby, it is customary to provide in context with such switchable operating modes different selectively enabled beam forming abilities. With an eye on such multimode hearing devices and according to the present invention one operating mode is characterized by the mode which was described, i.e. the mode enabling natural ear simulation due to the specific, frequency-dependent beam forming.

In spite of the fact that within the scope of the present invention the further microphone which is necessary for establishing beam forming ability and which may be provided remote from the microphone arrangement to be applied behind the pinna is most preferably provided as a part of the addressed microphone arrangement. Further, the device according to the present invention is preferably a behind-the-ear hearing device and thereby especially a behind-the-ear hearing aid device. We understand as a behind-the-ear device a device with an output converter applied to the same ear as the microphone arrangement. In a further mode the addressed further microphone is part of a second hearing device to be placed at the second ear of the individual so that the device according to the present invention is e.g. part of a binaural hearing system.

Further, the hearing device may be a device for increasing hearing capability or may be a device for hearing protection i.e. attenuating the effect of acoustical signals.

BRIEF DESCRIPTION OF THE DRAWINGS

The present invention shall now be further exemplified with the help of further figures. They show:

FIG. 8A shows a result of switching an operating mode.

DETAILED DESCRIPTION OF THE EXAMPLE EMBODIMENTS

Figure 1:
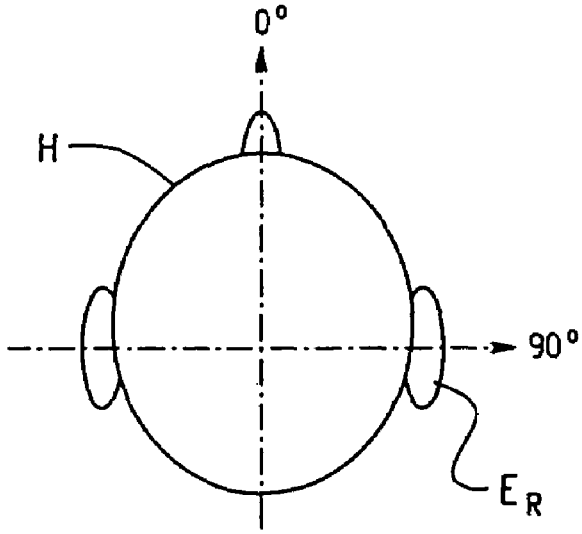
Fig. 1 Background Art
FIG. 1 shows an orientation of an individual's and the user's ears that is useful for describing the present invention.
Figure 7:
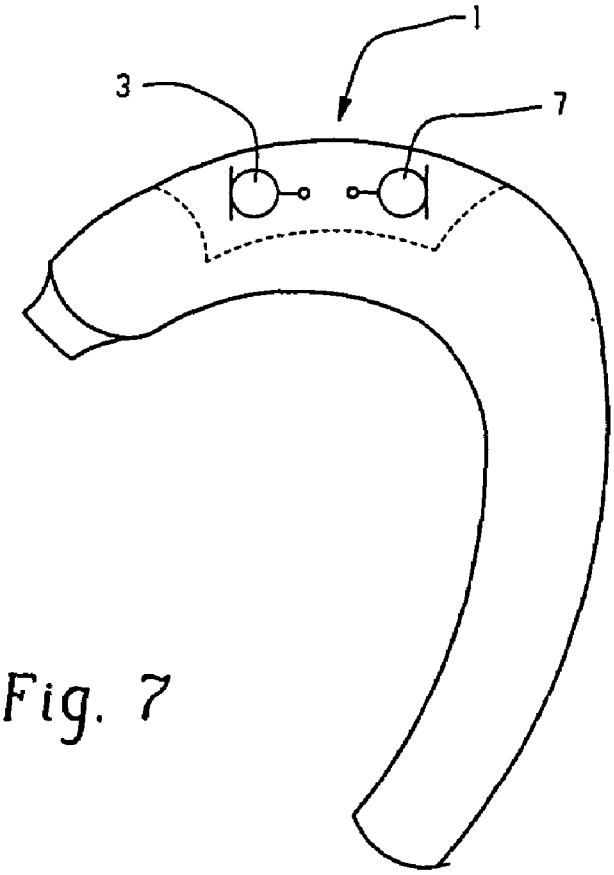
FIG. 7 by means of a schematic representation of a behind-the-ear hearing aid device, a preferred arrangement of the at least two microphones to be provided for establishing a device according to the present invention and FIG. 8 by means of schematic representation in analogy to that of FIG. 7, a further preferred embodiment of a hearing device according to the present invention.
Figure 2:
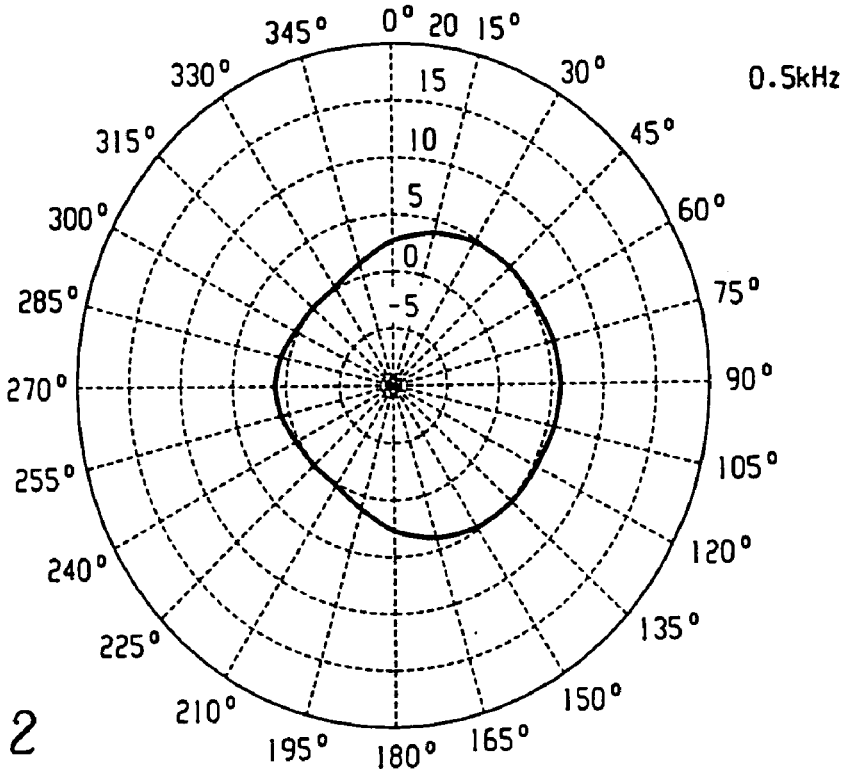
Fig. 2 Background Art
FIG. 2 shows typical right ear a transfer characteristic for acoustical signals at a frequency of 0.5 kHz.
Figure 3:
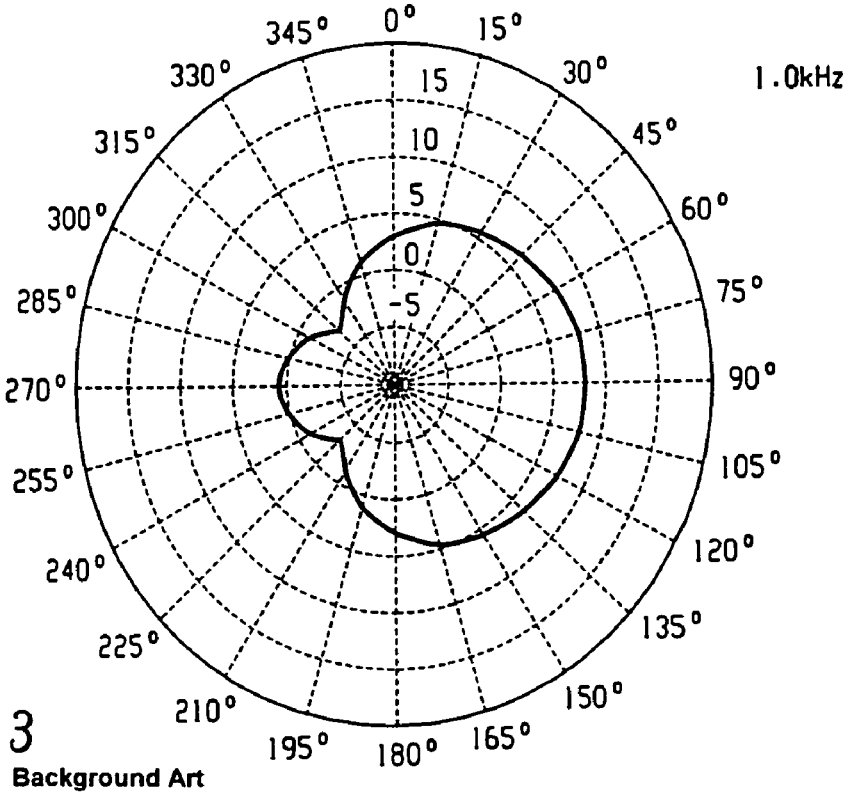
Fig. 3 Background Art
FIG. 3 shows the transfer characteristics for acoustical signals at 1 kHz.
Figure 4:
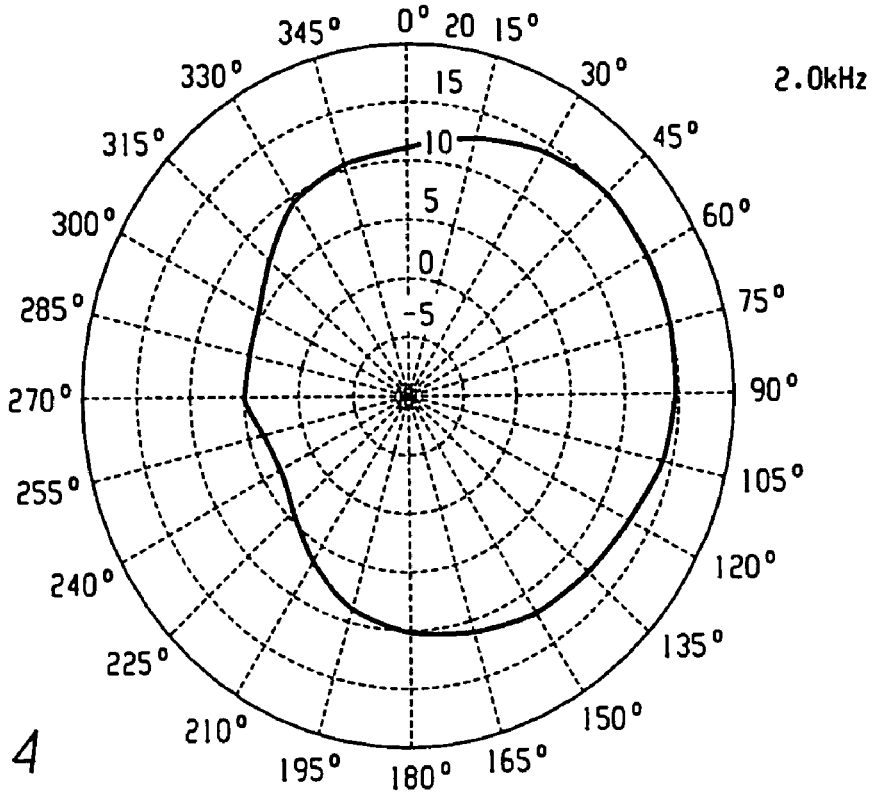
Fig. 4 Background Art
FIG. 4 shows the transfer characteristics for acoustical signals at 2 kHz.
Figure 5:
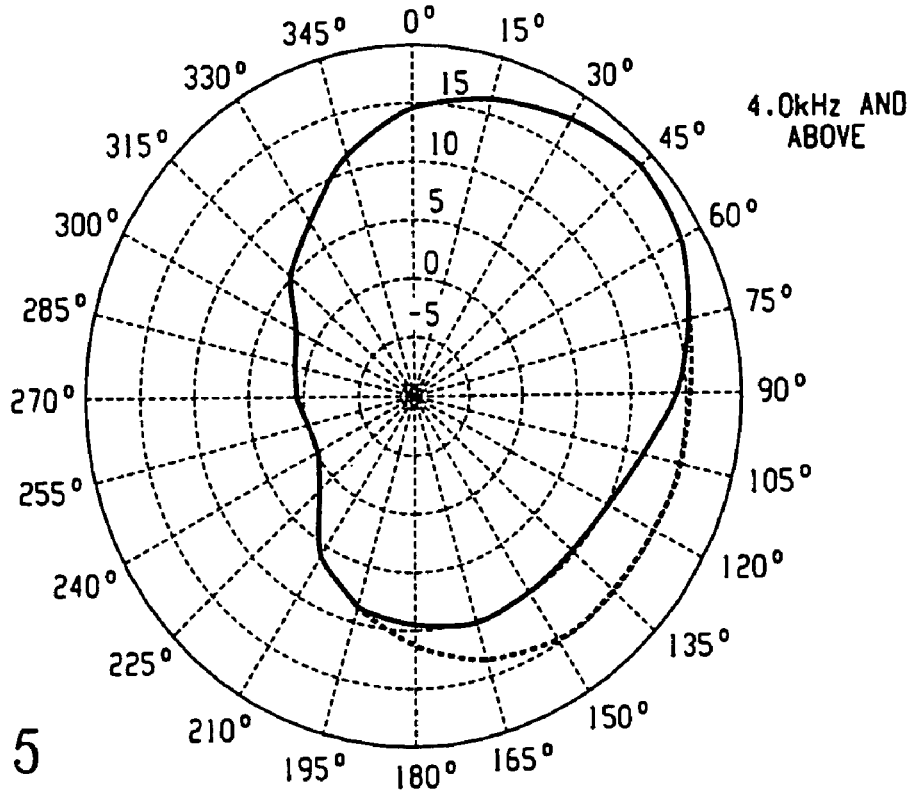
Fig. 5 Background Art
FIG. 5 shows the transfer characteristics for acoustical signals at 4 kHz.

According to FIG. 7, a microphone arrangement 1 of the device according to the present invention comprises at least one microphone 3, e.g. and in the most simple form of realization with an omnidirectional transfer characteristic as schematically shown at $T_1$. The microphone arrangement 1 is e.g. to be placed behind e.g. adjacent the top of individual's ear pinna 5. Remote from microphone 3 there is provided a further microphone 7, which, again in the simplest form, has an omnidirectional transfer characteristic $T_7$. The respective electrical outputs $A_3$, $A_7$ of the microphones 3 and 7 are operationally connected to a beam former unit 9(see FIG. 6). In a most simple form of realization the beam former unit 9 is a "delay and add" beam former unit. Nevertheless, for more sophisticated tailoring of the beam forming action of the unit 9 such beam forming unit may be realized as described in details in the WO 99/04598, in the WO 01/60112 or in the WO 99/09786, all of the same applicant as the present application. Thereby, the skilled artisan is aware of a multitude of different forms of realizing such a beam forming unit. According to the present invention the microphones 3, 7 and the beam former unit 9 provide for an omnidirectional characteristic up to about 2 kHz and, for higher frequencies, turn to a directional beam forming characteristic as e.g. to a first order cardioid transfer characteristic.

Figure 6:
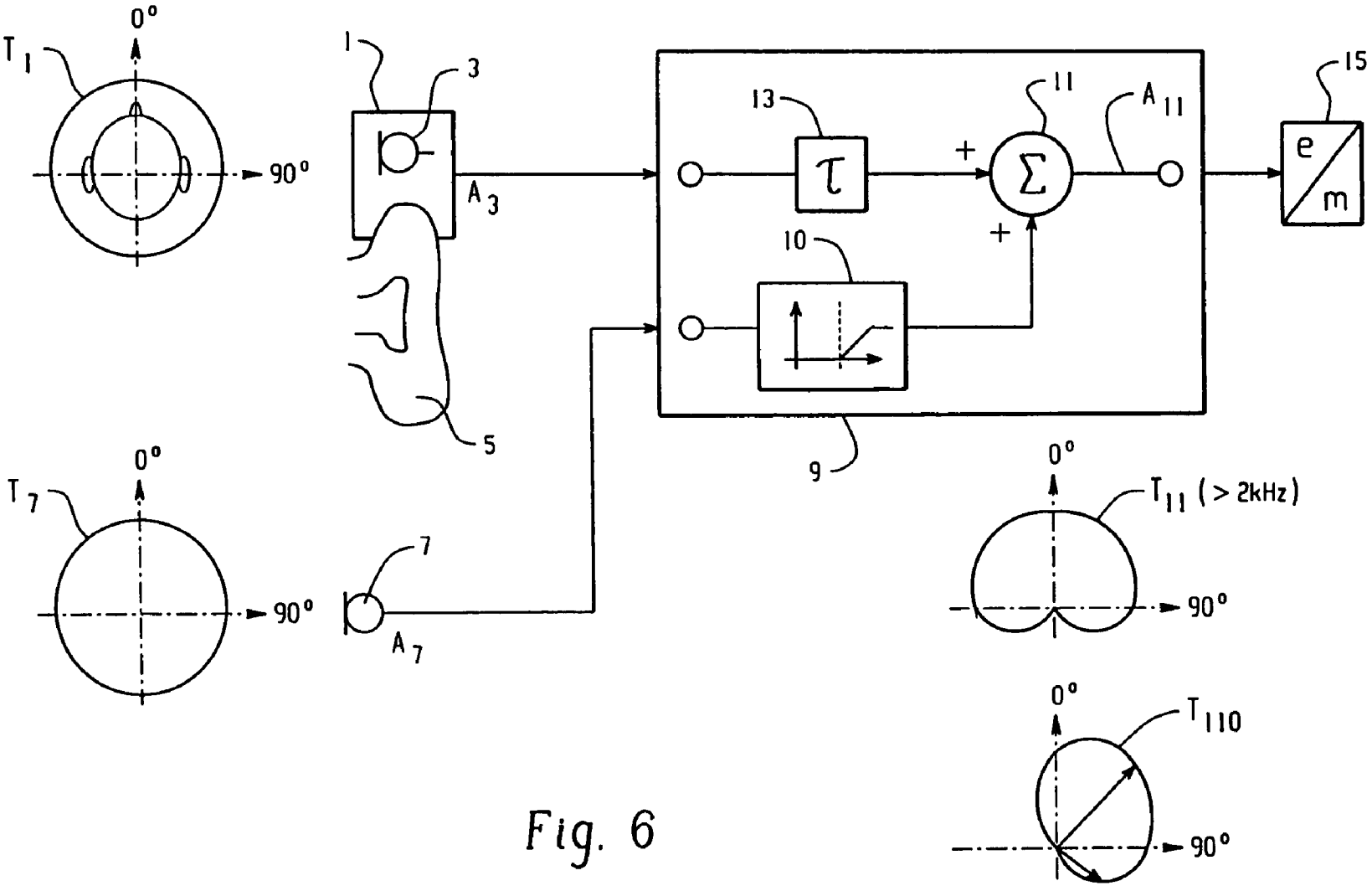
FIG. 6 a schematic simplified signal flow/functional block diagram of a hearing device according to the present invention.

As exemplified in FIG. 6 in a most simple way of realization, this is achieved by having the electrical signal from the output $A_7$ of the further omnidirectional microphone 7 first led via a high-pass filter unit 10 with a cut-off frequency at about 2 kHz before feeding such signal to the adding unit 11 of the beam forming unit 9. The electrical signal at the output $A_3$ of microphone 3 is fed via the delay unit 13 to the adding unit 11 as well known to the skilled artisan for delay and add beam forming technique.

Thus, up to the cut-off frequency of about 2 kHz the microphone 7 is not effective with respect to beam forming and thus the output signal at $A_{11}$ of adding unit 11 will establish for the omnidirectional characteristic according to $T_1$ of microphone 3. It is only starting at the cut-off frequency of filter unit 10 that the further microphone 7 becomes effective with respect to beam forming and establishes at the output $A_{11}$ a first order cardoid transfer function according to $T_1$, (<2 kHz) for frequencies of acoustical signals impinging on the microphones 3 and 7 above the cut-off frequency of filter unit 10.

The output $A_{11}$ of the adding unit 11 or more generically of beam forming unit 9 is operationally connected to an electrical/mechanical output converter 15 as to a loudspeaker unit of the device.

When applied to individual's ear the transfer characteristic $T_{11}$ will be subjected to individual's HRTF so that the established transfer characteristic will substantially be shadowed by individual's head between 180° and 0° resulting in a transfer function $T_{110}$ as schematically also shown in FIG. 6.

The at least two microphones 3 and 7 which have to be provided to establish the desired beam forming according to the present invention are further preferably used to realize at the hearing device additional desired beam characteristics by techniques as e.g. shown in the above mentioned references, so as to operate the device in different operating modes, e.g. acoustically focusing on desired acoustical sources, thereby attenuating unwanted noise. In such a case the specific frequency-dependent beam forming as exemplified by FIG. 6 is realized only as one of more than one different operating modes of the hearing device. Further, and as shown in FIG. 6 the further microphone 7 must, generically, be remote from microphone 3. It thereby may be part of a hearing device applied at the second ear, e.g. as a part of a binaural hearing system. Preferably and as shown schematically in FIG. 7, both microphones are parts of the microphone arrangement 1 which is placed adjacent the top of the pinna, thus forming part of one integrated single behind-the-ear hearing device, thereby especially of a hearing aid device.

In FIG. 8, there is shown a further preferred embodiment of the hearing device according to the present invention. It was already addressed that preferably more than one different operating modus of the hearing device are preferably provided. In FIG. 8, there is shown a first beam forming unit 9 which operates as was already described, i.e. simulating the directional behaviour of the pinna. Unit $\mathbf{9}_x$ represents a second beam former program or unit, whereat, according to specific needs at a specific acoustical situation, a different beam forming action is implemented. The outputs $A_9$ and $A_{9x}$ of the units 9 and $\mathbf{9}_x$ are operationally connected to a weighting unit 13 which has an output $A_{13}$ operationally connected to the electrical input of the electrical/mechanical output converter 15. As schematically shown within weighting unit 13 and preferably controlled at a control input $C_{13}$, the ratio, with which the output of unit 9 and the output of unit $\mathbf{9}_x$ take effect upon the output $A_{13}$, may be adjusted. Thus, and as also schematically shown in FIG. 8*a*, the hearing device may be switched abruptly from the operating mode controlled by unit 9 to the operating mode controlled by unit $\mathbf{9}_x$ by abruptly enabling output $A_9$ to take effect on output $A_{13}$, thereby disabling output $A_{9x}$ from taking such effect. This is shown by the courses (a) within FIG. 8*a*. Instead of abruptly switching such effect, and as shown by the courses (b), the effect of the at least two modi may steadily be varied by adjusting the weighting coefficients $\alpha_9$ and $\alpha_{9x}$ in unit 13 as by the control input $C_{13}$.

In FIG. 8, the device incorporating the two operating modes is shown and exemplified with two "units" 9 and $\mathbf{9}_x$, whereby, and as clear to the skilled artisan, the two units 9 and $\mathbf{9}_x$ may be realized by one single unit with a programmed transfer function. The ratio of effects, as controlled by unit 13 of FIG. 8, is then established e.g. by respectively adjusting, steadily or abruptly, coefficients of the program.

Further, and with an eye on FIG. 6, it is to be noted that the device, according to the present invention, has been shown especially with beam former unit 10 rather in analog technique. Nevertheless, it is perfectly clear that preferably beam forming is performed within a digital signal processing unit, whereby the output signal of the microphone is analog to digital converted and preferably time-domain/frequency-domain converted to allow signal processing in frequency domain. Before feeding the output signal to the ectrical/mechanical output converter, the computed output signal is reconverted from digital to analog and, respectively, from frequency domain to time domain.

What is claimed is:

1. A hearing device with a behind-the-ear microphone arrangement not to be placed in the ear canal of an individual's ear, said microphone arrangement having at least one microphone with an output further comprising an electrical/mechanical output converter, characterized by a further microphone, a beam former unit having at least two inputs and an output, one input being operationally connected to the output of said at least one microphone, the second input being operationally connected to the output of said further microphone, the output of said beam former unit being operationally connected to an input of said output converter, said beam former unit together with said at least one and said further microphones having a transfer characteristic of acoustical signals impinging on said at least one and said further microphones to an electric signal at said output of said beam former unit, the amplification thereof being dependent on direction with which said acoustical signals impinge on said microphones and on frequency of said acoustical signals, said direction being 0° in a direction that the individual is facing and 90° substantially in a direction from the individual's ear canal outward from said ear, said transfer characteristic having the following features: a substantially constant amplification independent of said direction of impinging at said frequency of 1 kHz, for said direction being 45°, a larger amplification than for said direction being 135° at said frequency of 5 kHz.

2. The hearing device of claim 1, wherein said amplification at said 45° direction is larger by approximate +6 dB than said amplification at said 135° direction, said frequency being 5 kHz.

3. The device of claim 1 or 2 having at least two controllably enabable operating modes with respect to transfer characteristic of acoustical signals impinging on said one and said further microphones to said electric signal at said output, one of said transfer characteristics being said transfer characteristic.

4. The device of claim 3 further comprising a controlled weighting unit controllably establishing the ratio of effect of said at least two operating modes upon said transfer characteristic.

5. The device of claim 4, wherein said controlled weighting unit steadily changes said ratio.

6. The device of one of claims 1 to 2, said further microphone being part of said microphone arrangement.

7. The device of one of claims 1 to 2, said further microphone being part of a second hearing device to be applied at a second ear of said individual.

8. The device of one of claims 1 to 2 being a behind-the-ear hearing device.

9. The device of one of claims 1 to 2 being a behind-the-ear hearing aid device.

10. The device of one of claims 1 to 2 being a hearing protection device.

* * * * *